United States Patent [19]

McAfee

[11] Patent Number: 4,799,529

[45] Date of Patent: Jan. 24, 1989

[54] WARDROBE DOOR

[75] Inventor: Thomas H. McAfee, Seal Beach, Calif.

[73] Assignee: Charmac, Inc., Compton, Calif.

[21] Appl. No.: 927,544

[22] Filed: Nov. 6, 1986

[51] Int. Cl.[4] ..... E05D 7/08; E05D 15/06; E04C 2/38

[52] U.S. Cl. ..... 160/206; 52/823; 49/388; 49/501; 160/DIG. 13; 160/201

[58] Field of Search ..... 52/823; 160/213, DIG. 13, 160/206, 197, 202, 205, 208, 201; 49/381, 388, 501, 504

[56] References Cited

U.S. PATENT DOCUMENTS

| | | | |
|---|---|---|---|
| 1,612,443 | 12/1926 | Johnson | 160/206 |
| 3,040,389 | 6/1962 | Fengler . | |
| 3,300,900 | 1/1967 | Risk | 49/381 |
| 3,373,529 | 3/1968 | Ingham | 49/381 |
| 3,426,482 | 2/1969 | Mock | 49/501 |
| 3,480,313 | 11/1969 | Halko, Jr. . | |
| 3,517,660 | 6/1970 | Springer et al. | 126/139 |
| 3,780,472 | 12/1973 | Biebuyck | 49/501 |
| 3,798,863 | 3/1974 | Latson | 52/400 |
| 3,864,051 | 2/1975 | Reid | 403/20 |
| 4,012,153 | 3/1977 | Pidgeon et al. | 403/231 |
| 4,013,371 | 3/1977 | Nagase | 403/169 |
| 4,145,844 | 3/1979 | Kaspar | 49/501 |
| 4,344,255 | 8/1982 | Knoll | 49/501 |
| 4,411,111 | 10/1983 | Hosooka | 49/504 |
| 4,527,364 | 7/1985 | Baus | 52/127.7 |
| 4,553,367 | 11/1985 | Redien | 52/657 |
| 4,555,868 | 12/1985 | Mancuso | 49/504 |
| 4,611,947 | 9/1986 | Baus | 403/403 |
| 4,631,894 | 12/1986 | Jerila | 52/823 |
| 4,644,992 | 2/1987 | Jerila | 52/823 |

OTHER PUBLICATIONS

Acme Series Mirror Bifold Doors, 1980.

Acme Fine Line Series 4400 Bifold Doors, Mar. 1985.

*Primary Examiner*—John E. Murtagh

*Attorney, Agent, or Firm*—Fulwider, Patton, Rieber, Lee & Utecht

[57] ABSTRACT

A sliding or swinging wardrobe door is sturdy and attractive and is quickly and easily assembled from a minimal number of inexpensive, lightweight and standardized components. The stiles and rails of the door frame have identical profiles and are cut as needed from a continuous length of inexpensive and lightweight aluminum channel stock. The stock is formed with a longitudinally continuous rear structure flange which improves appearance, adds strength and rigidity, and provides a site for mounting flush or recessed rollers. A longitudinally continuous internal screw race is used to add extensions onto the stock and to join the stiles and rails at mitered corners without the use of separate connecting brackets. A solid internal corner block provides a site for mounting door hinges. The block is two-sided to permit left-hand or right-hand use and is attached to the frame without the use of screws or brackets.

13 Claims, 2 Drawing Sheets

WARDROBE DOOR

BACKGROUND OF THE INVENTION

This invention relates generally to doors and more particulary has reference to wardrobe doors of the type which slide along a track or swing on hinges mounted on a doorjamb, another door, or some other structure.

Doors of the type described are frequently used with wardrobe closets found throughout the home. Those closets typically have door openings which are designed in various styles, shapes and sizes. Identically designed openings often differ in size or shape as a result of construction tolerances or deviations from design specifications.

That problem is usually addressed by constructing the door only after the opening has been measured. With the measurements in hand, the style of door can be selected and the components of the door can then be produced in the proper size and assembled in the desired configuration.

To hold down the cost of this type of construction, it is necessary that the door be made from relatively inexpensive components which have been standardized and reduced in number to the extent possible. Each component should be adaptable for use in any of the various styles, sizes and shapes of doors likely to be required. Adaptation should be accomplished with minimal effort and little waste of material.

It is often the case that the door must be delivered or installed immediately after the measurements have been taken. Accordingly, the process for adapting and assembling the components must be simple enough to be accomplished quickly and easily by a worker in the factory or, when necessary, an on-site workman. The number of tools and facilities required for final assembly must be kept to a minimum.

The cost considerations, combined with a need to minimize weight, frequently leads to the use of hollow or channel stock for the door frame members. Unfortunately, existing frame designs using those materials tend to be weak and flimsy and not well suited for securely and properly mounting the various rollers and hinges associated with sliding doors and swinging doors.

It is usually preferred to provide the door frame with mitered corners. Miter joints are generally stronger than corner butts and have a more aesthetically pleasing appearance. In existing doors, this requirement has been incompatible with the use of standardized channel stock frame members and the goals of simplifying construction and minimizing the number of components. An L-shaped or angled connecting bracket has been required for joining the frame members at the mitered corners. The connecting brackets are relatively expensive because they must be carefully designed and machined to avoid distorting or separating the corner. They also complicate the frame assembly process. To form the corner, an assembler must first coordinate the positioning and relative alignment of three components, namely the connecting bracket and the two frame members to be joined, and must then maintain those positions and alignments while performing whatever additional operations, such as turning screws, that may be necessary to secure the components to each other.

Accordingly, no existing wardrobe door has proved entirely satisfactory.

SUMMARY OF THE INVENTION

The present invention overcomes the problems which exist in the prior art by providing a sturdy and attractive wardrobe door which is quickly and easily assembled from a minimum number of inexpensive, lightweight and standardized components. The components are readily and economically adaptable to various styles, sizes and shapes of doors. The door is well suited for securely and properly receiving the various roller or hinge attachments needed to mount the door for sliding or swinging movement.

The stiles and rails of the door frame have identical cross-sections or profiles. They are easily cut as needed from a continuous length of extruded stock once the style, size and shape of the door have been determined. This standardization minimizes waste, reduces the amount of manufacturing facilities and inventory which must be kept on hand, and provides for quick, easy and economical adaptability and assembly.

The stiles and rails are made from inexpensive and lightweight aluminum channel stock which is formed with a longitudinally continuous rear structure flange. The flange adds strength and rigidity to the stock and provides a site for securely mounting rollers, especially rollers mounted in a flush or recessed fashion. It also provides the rear of the frame with an attractive appearance.

An internal corner block formed of solid wood or other solid material provides a site for securely mounting hinges for a swinging door. The block is made compatible with either left-hand or right-hand use to simplify assembly and reduce assembly time. It attaches to the independently joined frame members without any additional connecting devices or any post-assembly connecting steps.

The channel stock is also formed with a longitudinally continuous internal screw race or spline. The race is constructed and arranged to allow the stiles and rails to be connected by the desired miter joints without the use of separate connecting brackets. Elimination of this extraneous component reduces inventory requirements and manufacturing costs and simplifies the frame assembly process.

The screw races are also constructed and arranged for easily joining separate pieces of stock in a lengthwise manner. The resulting ability to vary the length of the stock by adding extensions provides additional adaptability and further reduces waste by creating a use for pieces of stock which would otherwise be discarded.

Objects of the invention are, therefore, to provide an improved door and to provide a door which is sturdy and attractive and is quickly and easily assembled from a minimal number of inexpensive, lightweight and standardized components.

Another object of the invention is to provide door frame components which are readily and economically adaptable to various styles, sizes and shapes of doors.

A further object of the invention is to provide a door frame made from channel stock which is well suited for securely and properly receiving roller attachments.

Another object of the invention is to provide a frame made from channel stock including a longitudinally continuous internal screw race which allows stiles and rails of identical profile to be connected at miter joints without the use of separate connecting brackets.

A further object of the invention is to provide a frame made from channel stock including a longitudinally continuous rear structure flange which adds strength and rigidity, provides a site for securely mounting rollers, and provides the rear of the frame with an attractive appearance.

Still another object of the invention is to provide channel stock for frames which can be easily joined in a lengthwise manner.

Still another object of the invention is to provide a frame formed of channel stock and having a solid internal corner block for receiving hinge attachments.

Other features and advantages of the invention will become apparent for the following detailed description taken in conjunction with the accompanying drawings, which illustrate, by way of example, the features of the invention.

DETAILED DESCRIPTION OF THE DRAWINGS

Figure 1:
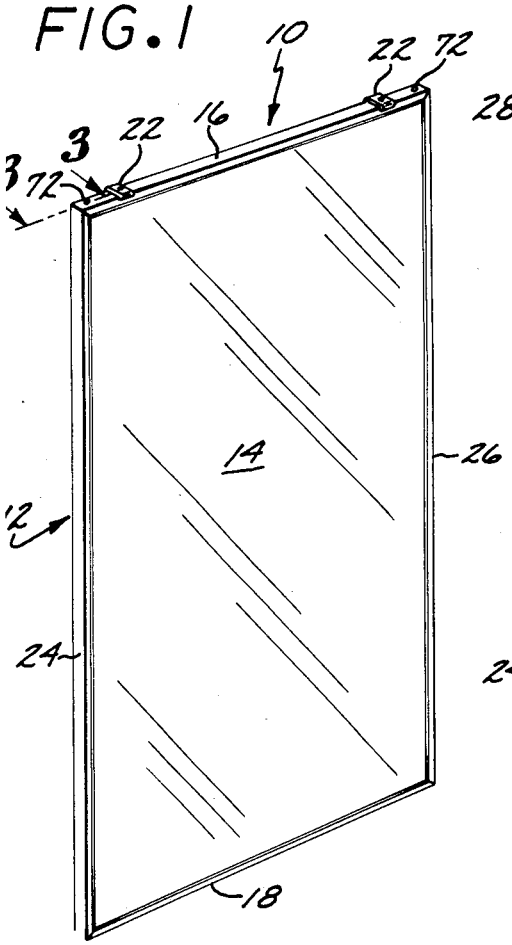
FIG. 1 is a perspective view of a sliding door embodying features of the present invention.
Figure 2:
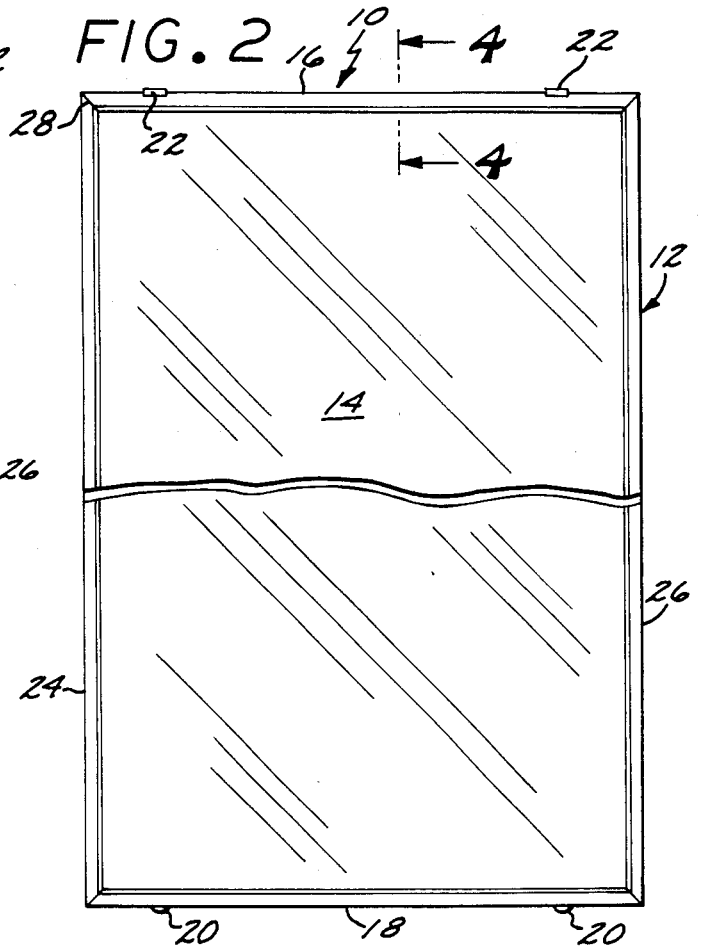
FIG. 2 is a broken front elevational view, in enlarged scale, of the door shown in FIG. 1.

As shown in the drawings for purposes of illustration, and with initial reference to FIGS. 1 and 2, the invention is embodied in a sliding wardrobe door 10 which includes a frame 12 around the perimeter of a panel 14. The top rail 16 and bottom rail 18 are adapted to be slideably received in tracks (not shown) mounted on the transom and floor respectively around the opening into a wardrobe closet or similar structure. The door 10 moves along the tracks aided by a pair of guide rollers 20 mounted near the corners of the frame 12 along the bottom rail 18 and pair of anti-friction slide pads 22 mounted near the corner of the frame 12 along the top rail 16. The frame 12 and panel 14 can be made from various materials, but in the preferred embodiment, the panel 14 is a mirror and the frame 12 is formed of aluminum channel stock.

Figure 3:
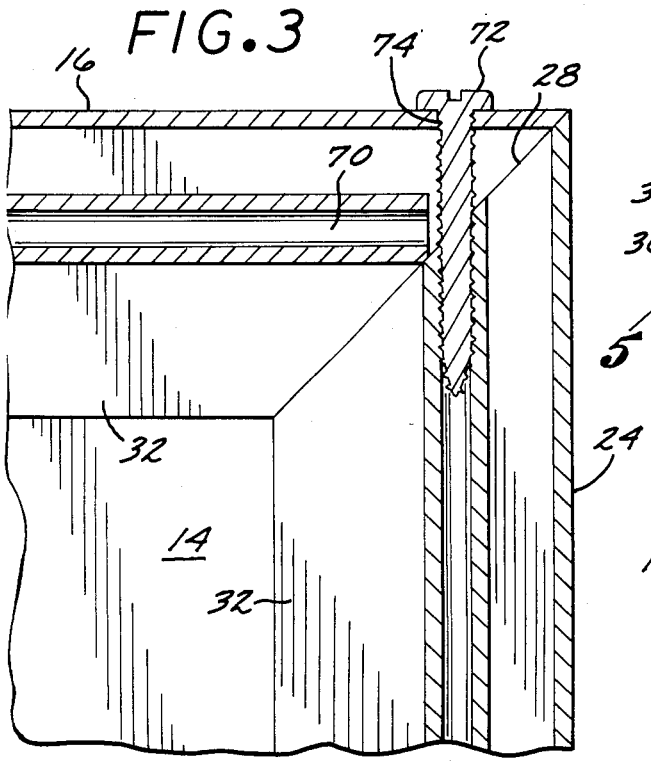
FIG. 3 is a fragmentary sectional view in enlarged scale, taken along the line 3—3 of FIG. 1.
Figure 4:
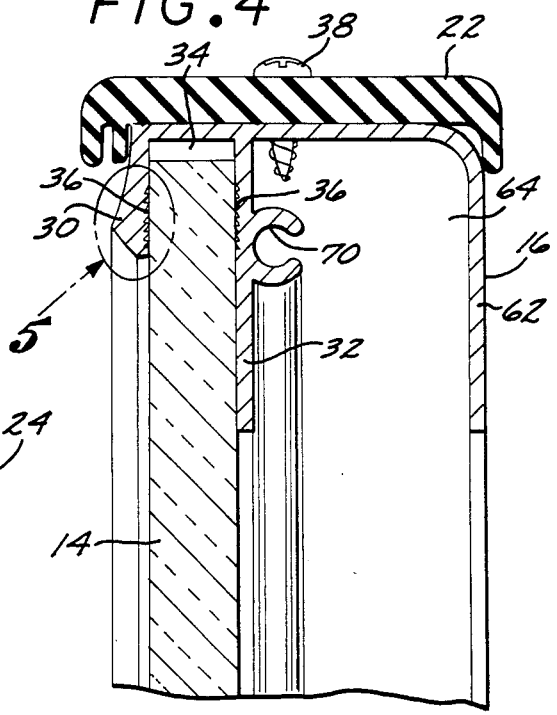
FIG. 4 is a fragmentary sectional view, in enlarged scale, taken along the line 4—4 of FIG. 2.
Figure 5:
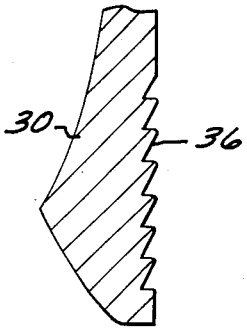
FIG. 5 is an enlarged fragmentary sectional view of the mirror holding flange which is circled in FIG. 4.

Referring to FIGS. 3–5, the rails 16,18 and stiles 24,26 of the frame 12 are provided with spaced-apart, parallel, panel holding flanges 30,32 which form a channel 34 that receives the edge of the panel 14 to hold the panel 14 in the frame 12. The surfaces of the flanges 30,32 in contact with the oppositely disposed surfaces of the panel 14 are provided with serrations or ribs 36 that engage the surfaces of the panel 14 to reduce slippage between the panel 14 and the frame 12. The corners of the frame 12 are formed by connecting the rails 16,18 to the stiles 24,26 at 45° miter joints 28. The slide pads 22 are connected to the top rail by screws 38.

Figure 6:
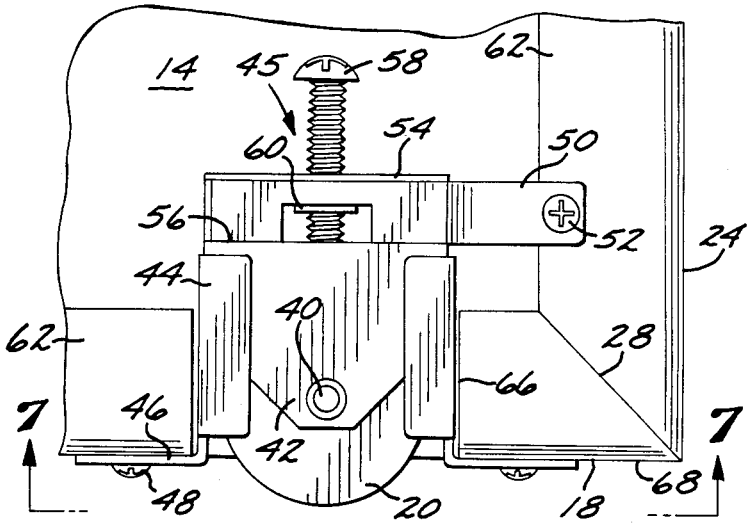
FIG. 6 is a fragmentary rear elevational view, in enlarged scale, of the lower right corner of the frame shown in FIG. 1, illustrating the mounting of the roller.
Figure 7:
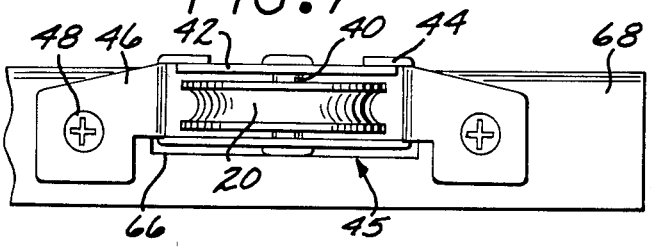
FIG. 7 is a fragmentary bottom plan view taken along the line 7—7 of FIG. 6.

Referring to FIGS. 6 and 7, the guide rollers 20 along the bottom rail 18 of the frame 12 are journaled on shafts 40 mounted in frames 42. The frames 42 are slideably received in the guide portions 44 of brackets 45 having lower flanges 46 connected to the lower surface of the bottom rail 18 by screws 48 and upper flanges 50 connected to the rear surface of the adjacent stile 24,26 by screws 52. The brackets 45 have a pair of oppositely extending upper flanges 50 even though only one of the flanges 50 is attached to a stile 24,26 in order to provide a standardized bracket 45 which can be used in any corner of the frame 12 without a change in structure.

The brackets 45 are further provided with upper flanges 54 which are parallel to and spaced above the top surface 56 of the roller frame 42. Adjusting screws 58 threaded through nuts 60 mounted adjacent the upper flanges 54 bear against the top surface 56 of the roller frames 42 to adjust the location of the frames 42 within the guides 44. Accordingly, the adjusting screws 58 can be rotated to vary the extention of the rollers 20 below the bottom rail 18 for the purpose of seating the rollers 20 in the track (not shown) running along the floor and, by differential adjustment of the rollers 20 in the opposite corners of the frame 12, to balance the frame 12. The rollers are grooved to engage a guide bar (not shown) which runs lengthwise along the track.

The frame 12 is constructed and arranged to be sturdy and attractive. The rails 16,18 and stiles 24,26 are inexpensive, lightweight and standardized components which can be quickly and easily assembled to form the frame 12 without the use of additional connecting brackets. The rails 16,18 and stiles 24,26 are readily and ecomonically adaptable to form frames for doors of various styles, sizes and shapes. The frame 12 is also well suited for securely and properly receiving the roller bracket used with a sliding door or, alternatively, for securely and properly receiving the hinge attachments needed to mount the door for swinging movement.

Referring to FIGS. 3 and 4, the rails 16,18 and stiles 24,26 have identical cross-sections or profiles. Preferably, they are cut as needed from a continuous length of extruded aluminum channel stock which is lightweight and relatively inexpensive. This standardization of the configuration of the rails 16,18 and stiles 24,26 minimizes waste, reduces the amount of manufacturing facilities and inventory which must be kept on hand, and provides for quick, easy and economical adaptability and assembly of the frame 12.

A longitudinally continuous rear structure flange 62 is formed integrally with the channel stock. The flange 62 is parallel to and spaced from the rear panel holding flange 32 to form an elongated cavity 64 which extends the length of the stock. The structure flange 62 cooperates with the panel holding flanges 30,32 to impart rigidity and strength to the stock. It also has a width equal to that of the panel holding flanges 30,32 to provide the rear of the frame 12 with an attractive and finished appearance.

Referring to FIGS. 6 and 7, the structure flange 62 provides a site for securely mounting the roller bracket 45 on the frame 12 in a flush and recessed manner. Notches 66 are cut into the structure flange 62 of the bottom rail 18 at the desired locations of the rollers 20.

The notches 66 extend into the bottom wall 68 of the rail 18 to a distance up to the location of the rear panel holding flange 32. The notches 66 are sized and shaped to conformingly receive the roller bracket 45 so that the outer surface of the bracket 45 will be substantially flush with the structure flange 62. The lower flanges 46 of the bracket 45 are secured to the bottom wall 68 by the screws 48 and the outermost upper flange 50 is secured to the structure flange 62 of the adjacent stile 24,26 by the screw 52. It will be appreciated that a roller bracket 45 mounted in this manner will be securely attached to the frame 12 in an unobstructive and protected manner.

Referring again to FIGS. 3 and 4, a longitudinally continuous internal screw race or spline 70 is formed integrally with the rear surface of the panel holding flange 32 lying against the rear surface of the panel 14. When a rail 16,18 is abutted against a stile 24,26 at a miter joint 28, the screw race 70 of the stile 24,26 terminates at the joint 28 and is arranged to receive a screw 72, preferably a tapping screw, which extends through a bore 74 formed in the wall of the rail 16,18 which is perpendicular to the rail flanges 30,32,62. The screw 72 is coaxially threaded into the race 70 to secure the rail 16,18 to the stile 24,26. No additional connecting brackets are needed to complete the miter joint.

It will be appreciated that the ability to form the miter joint without the us of separate connecting brackets reduces inventory requirements and manufacturing costs and simplifies the frame assembly process. In the latter respect, the frame is assembled simply by bringing the rails 16,18 and stiles 24,26 into abutment with each other at the miter joints 28, inserting the screws 72 into the bores 74, and then threading screws 72 into the races 70. The rails 16,18 and stiles 24,26 tend to be held in their proper positions as soon as the screws 72 are started into the races 70. Accordingly, the procedure for securing the corners using the present invention actually promotes and facilitates formation of the corners, unlike the existing techniques and structures where the need to coordinate the frame members with a separate connecting bracket makes it more difficult to keep the frame members in place while securing the corner connection.

The races 70 can also be used to connect separate pieces of stock in a lengthwise manner. The pieces are secured to each other by threading a stud or ferrule into the abutting races 70. This technique can be used to vary the lengths of the rails 16,18 and stiles 24,26 by adding additional pieces of stock as extensions. This enhances adaptability of the rails 16,18 and stiles 24,26 and also reduces waste by converting otherwise useless short lengths of stock into extension pieces and by eliminating the need to discard rails 16,18 and stiles 24,26 which have been cut to the wrong size.

While the invention has been described thus far with reference to a sliding door 10, it is appreciated that the invention is also applicable to a door which swings on hinges or pivots mounted on a door jamb, another door, or some other structure.

Figure 8:
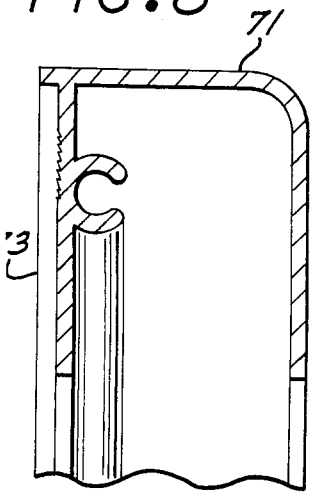
FIG. 8 is a sectional view similar to FIG. 4 but of a second embodiment of the present invention.

The embodiment shown in FIG. 8 is similar to that shown in FIG. 4, except that the channel stock 71 is formed with a front flange 73 to which the mirror (not shown) is bonded.

Figure 9:
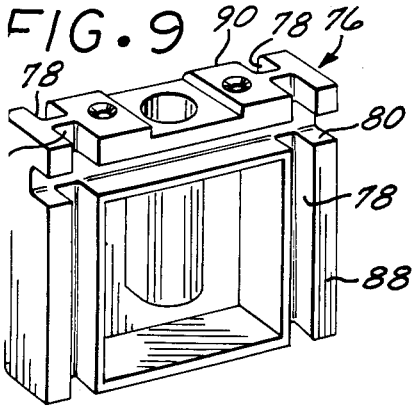
FIG. 9 is a perspective view of a corner block embodying features of the present invention.
Figure 10:
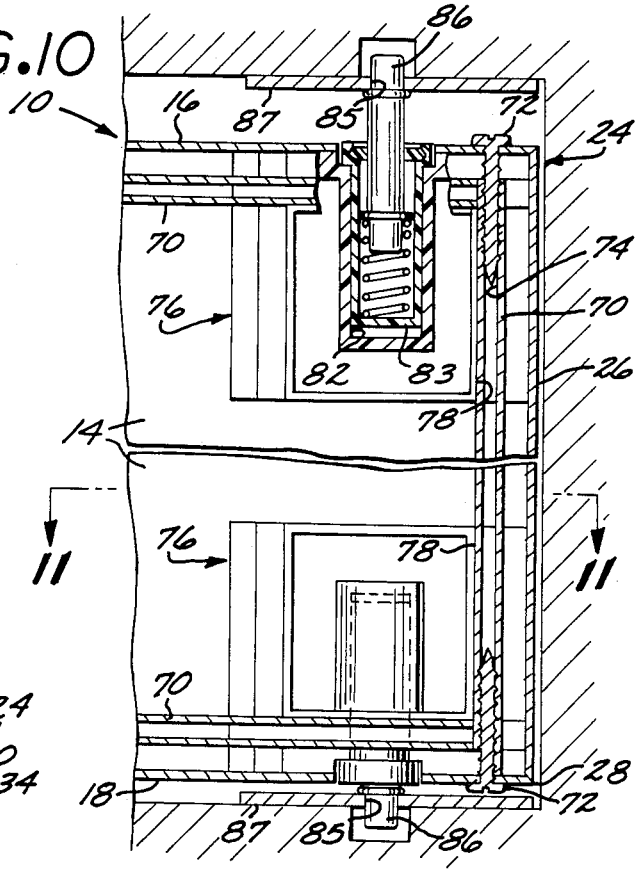
FIG. 10 is a fragmentary vertical sectional view of a third embodiment of the present invention incorporating the block shown in FIG. 9.
Figure 11:
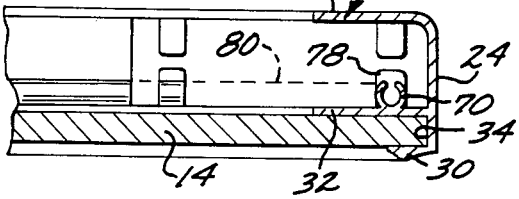
FIG. 11 is a fragmentary sectional view taken along the line 11—11 of FIG. 9.

Referring to FIGS. 9–11, a corner block 76 preferably formed of plastic, is held in compressive position at each of the corners of the frame 12 where a door hinge or pivot is to be attached. The block 76 is received in the elongated cavities 64 of the abutting rail 16,18 and stile 24,26. Orthogonal grooves 78,80 on a face of the block receive the respective screw races 70 of the rail 16,18 and stile 24,26 to hold the block 76 in the frame 12 without the use of any additional connecting devices. The grooves 78,80 intersect adjacent a corner region of the block 76. The block 76 may be formed with an open ended vertical bore 82 into which is fit a barrel 83 from which a spring loaded pivot pin 86 projects. The pins 86 at the top and bottom of the door are received in bores 85 formed in facing plates 87 mounted at the top and bottom of the door jamb to act as hinges on which the door rides.

An identical set of grooves are provided on the front and back side at the opposite side of the block 76 so that the block 76 can be used in a right-hand or left-hand manner in opposed corners of the frame and at the top and bottom thereof. This simplifies frame assembly and reduces assembly time because it makes it unnecessary for the assembler to flip the block over. The block 76 can be properly inserted into any corner of the frame regardless of which face 88,90 is exposed.

The block 76 is put in place as part of the process for assembling the rails 16,18 and stiles 24,26 into the miter joints. The screw races of the rail 16,18 and stile 24,26 are slid into respective ones of the orthogonal grooves 78,80 on a face 88,90 of the block 76. The grooves 78,80 guide the rail 16, 18 and stile 24,26 into the positions required to form the miter joint 28. The block 76 also helps hold the rail 16,18 and stile 24,26 in their respective positions while the screw 72 is inserted into the bore 74 and the screw race 70. Securing the miter joint by tightening the screw 72 is all that is needed to hold the block 76 in proper position in the frame 12. Notwithstanding those features, it is understood that the block 76 is not necessary for securing the miter joints, those joints being independently secured in a manner identical to that described with reference to FIGS. 3 and 4.

From the foregoing it will be appreciated that a door embodying features of the present invention is sturdy and attractive and is quickly and easily assembled from a minimal number of inexpensive, lightweight and standardized components. Further, the components are readily and economically adaptable to various styles, sizes and shapes of doors. The door is well suited for securely and properly receiving the various roller and hinge attachments needed to mount the door for sliding or swinging movement.

While a particular form of the invention has been illustrated and described, it will be apparent that various modifications can be made without departing from the spirit and scope of the invention.

I claim:

1. A door structure comprising:

a panel having a central region and a parameter region, a plurality of frame members formed of channel stock having an internal longitudinal spline having a screw race and being substantially identical in cross-section disposed about said perimeter region of the panel and being connected together to form mitered corners, a solid block disposed within said frame members at one or more of said corners, and a door hinge connected to said solid block, said solid block being provided with grooves which receive said spline to hold said solid block within said frame member.

2. The structure of claim 1 wherein:

said block has first and second oppositely disposed faces, identical ones of said grooves being provided in both of said faces.

3. The structure of claim 1 wherein:

said grooves comprise first and second orthogonally disposed grooves.

4. The structure of claim 3 wherein:

said first and second grooves intersect adjacent a corner region of said block.

5. A door structure adapted to be mounted in a door jamb, said door structure comprising:

a central panel having a central region and a perimeter region and first and second oppositely disposed panel surfaces;

a frame comprising a plurality of frame members each of which is formed of channel stock substantially identical in cross-section, said frame members being disposed about said perimeter region of the panel and being connected together at mitered corners to form said frame; said channel stock frame members having a bottom wall, a first exterior panel holding flange and a second, interior panel holding flange extending from said bottom wall disposed upon said first and second panel surfaces respectively for holding the panel in the frame, and an exterior structure flange spaced from and substantially parallel to said first and second panel holding flanges, said second, interior panel holding flange having a raised spline containing an internal screw race, and said frame being secured together at said mitered corners by screws introduced into said screw races; and a means for mounting said door structure for opening and closing movement within said door jamb, said means for mounting being secured within said frame to the bottom wall of one of said frame members, and to one other of said frame members forming one of said mitered corners, said bottom wall of said one frame member having an opening formed therein, and said means for mounting having means for contacting said door jamb extending through said bottom wall opening.

6. The structure of claim 5 further comprising:

a longitudinally extending spline positioned between said panel holding flanges and said structure flange.

7. The structure of claim 6 wherein:

the structure flange and the adjacent one of said panel flanges have substantially equal widths.

8. The door structure of claim 5, wherein said means for mounting comprises roller means for rollably mounting said door structure, said roller means being disposed within a notch formed in said structure flange.

9. The door structure of claim 5, wherein said means for mounting comprises a solid block and a door hinge connected to said solid block.

10. The structure of claim 8 wherein:

the roller means is secured to said structure flange.

11. The structure of claim 9 wherein:

said door hinge comprises hinge screws in threaded engagement with said block.

12. The structure of claim 11 wherein:

the solid block is formed of wood.

13. The structure of claim 9 wherein:

said channel stock comprises first and second spaced-apart, parallel, panel holding flanges disposed upon said first and second panel surfaces respectively for holding the panel in the frame and a structure flange spaced from and substantially parallel to said first and second panel holding flanges, said block being positioned between said panel holding flanges and said structure flange.

* * * * *